US006644943B1

(12) United States Patent
Lilie et al.

(10) Patent No.: US 6,644,943 B1
(45) Date of Patent: Nov. 11, 2003

(54) RECIPROCATING COMPRESSOR WITH A LINEAR MOTOR

(75) Inventors: Dietmar Erich Bernhard Lilie, Joinville SC (BR); Egídio Berwanger, Joinville SC (BR)

(73) Assignee: Empresa Brasileira de Compressores S/A Embraco, Joinville-SC (BR)

( * ) Notice: Subject to any disclaimer, the term of this patent is extended or adjusted under 35 U.S.C. 154(b) by 0 days.

(21) Appl. No.: 09/856,442

(22) PCT Filed: Oct. 15, 1999

(86) PCT No.: PCT/BR99/00087

§ 371 (c)(1),
(2), (4) Date: Jul. 19, 2001

(87) PCT Pub. No.: WO00/31418

PCT Pub. Date: Jun. 2, 2000

(30) Foreign Application Priority Data

Nov. 24, 1998 (BR) ..... 9805280

(51) Int. Cl.[7] ..... F04B 35/04

(52) U.S. Cl. ..... 417/418; 417/545

(58) Field of Search ..... 417/418, 419, 417/259, 545, 555.1, 417, 487, 488

(56) References Cited

U.S. PATENT DOCUMENTS

| | | | | | |
|---|---|---|---|---|---|
| 5,275,542 | A | * | 1/1994 | Terauchi | 417/417 |
| 5,494,410 | A | * | 2/1996 | Maier-Luxhuber et al. | 417/53 |
| 5,662,461 | A | | 9/1997 | Ono | |
| 6,015,270 | A | * | 1/2000 | Roth | 417/259 |
| 6,326,706 | B1 | * | 12/2001 | Zhang | 310/12 |
| 6,358,026 | B1 | * | 3/2002 | Palmore | 417/545 |

* cited by examiner

*Primary Examiner*—Teresa Walberg
*Assistant Examiner*—Vinod D. Patel
(74) *Attorney, Agent, or Firm*—Darby & Darby

(57) ABSTRACT

A reciporcating compressor with a linear motor, comprising a pair of pistons (4) provided inside a cylinder (3) and axially aligned to each other, at least one of said pistons (4) being provided with a discharge valve (10) for controlling the discharge of the gas admitted inside the cylinder (3) through said piston (4).

8 Claims, 4 Drawing Sheets

RECIPROCATING COMPRESSOR WITH A LINEAR MOTOR

FIELD OF THE INVENTION

The present invention refers to a reciprocating compressor with two pistons driven by a linear motor, to be applied to refrigeration systems.

BACKGROUND OF THE INVENTION

In the reciprocating compressors with two pistons driven by a linear motor there is a reduction in the number of parts with relative movement, as compared to the conventional constructions of compressors with a rotary motor, which results in gains in terms of dissipated power in the bearings.

In a known construction of a reciprocating compressor driven by a linear motor, with two pistons being mounted axially aligned to each other and reciprocating inside the same cylinder, the gas suction and compression operations result from opposite axial movements of both pistons inside the cylinder, respectively by mutual movements of separation and approximation, said pistons being individually coupled to respective actuating means, usually tubular and external to the cylinder and provided with magnets, which are axially impelled upon energization of respective linear motor portions usually affixed outside the cylinder.

The gas suction occurs through the pistons themselves and is controlled by suction valves, each positioned on the top of the respective piston.

In one of the known solutions, the gas discharge is effected through a radial slot produced in the lateral wall of the cylinder in a median region thereof, which is defined when the pistons are in a maximum approximation condition (upper dead point), said radial slot being opened towards said median region through a median radial discharge orifice, the gas discharge being controlled by a discharge valve positioned in said slot and conducted to an opening condition during the mutual approximation movement of said pistons.

In order to minimize the losses during compression, the pistons should reach a maximum mutual approximation, practically closing the median radial discharge orifice of the cylinder. A disadvantage of this solution is that, since the discharge orifice is located laterally in the cylinder, when the pistons reach the maximum mutual approximation (upper dead point), they cover almost totally the discharge orifice, impairing the discharge of the gas.

In this case, it should be foreseen a dead volume (FIG. 1) produced in the cylinder body, close to the discharge orifice, in order to store gas at the end of compression. However, this solution reduces the volumetric yield of the compressor.

Another option is to determine a movement for the pistons which, when in the maximum mutual approximation, does not determine the closing of the orifice. In this case, however, it occurs the formation of a volume between the pistons at the region of the discharge orifice, resulting in constant yield loss (FIG. 1).

Besides these deficiencies, another disadvantage of the constructions known in the art refers to the fact that the discharge orifice is located laterally in the cylinder, impairing the exit of the gas present in the region which is diametrically opposite to that where the orifice is provided in the cylinder, at the end of compression. These effects, whether combined or isolated, reduce the volumetric yield of the compressor.

DISCLOSURE OF THE INVENTION

Thus, it is an object of the present invention to provide a reciprocating compressor with a linear motor, having minimum vibration during operation and maximum volumetric yield, suppressing the lateral gas discharge and the volume of the gas discharge therein.

This and other objectives are achieved by a reciprocating compressor with a linear motor, comprising a cylinder; a pair of pistons provided inside the cylinder and axially aligned to each other; a linear motor driving the pistons in opposite directions; a suction valve provided in at least one of the pistons, controlling the gas admission to the inside of the cylinder; and a discharge valve provided in order to control the discharge of the gas admitted inside the cylinder, at least one of the pistons being provided, on its top face, with a respective discharge valve, in order to control the axial discharge of the gas through said piston.

BRIEF DESCRIPTION OF THE DRAWINGS

The invention will be described below, with reference to the attached drawings, in which.

DESCRIPTION OF THE ILLUSTRATED EMBODIMENT

Figure 1:
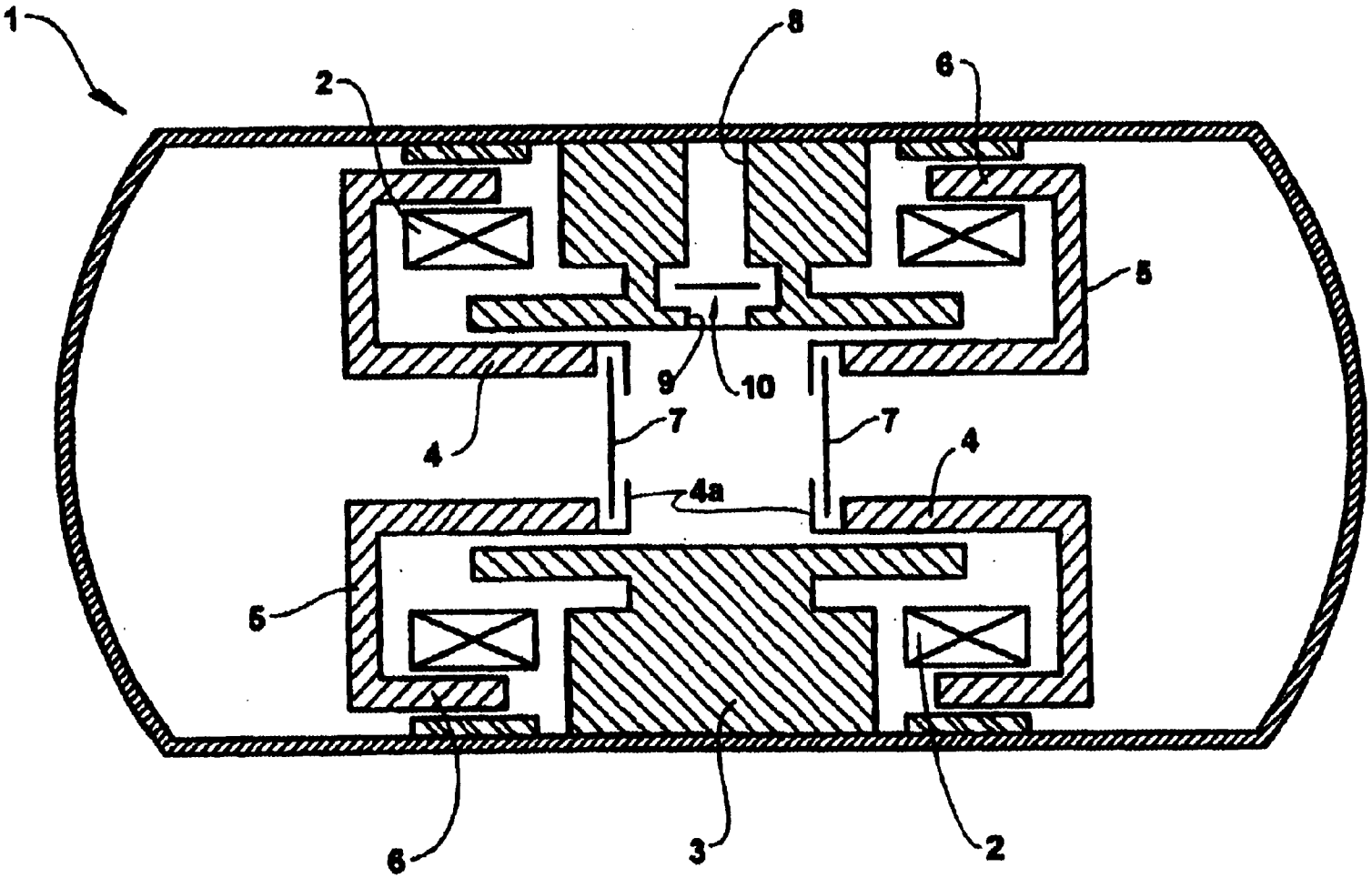
FIG. 1 PRIOR ART
FIG. 1 shows, schematically, a longitudinal diametral sectional view of part of a reciprocating compressor with a linear motor, constructed according to the prior art.

The present invention will be described in relation to a reciprocating compressor used in refrigeration systems and driven by a linear motor mounted inside a hermetic shell 1 having a discharge tube (not illustrated) connecting the compressor to, for example, a refrigeration system, said linear motor comprising motor portions 2 axially aligned to each other and usually affixed outside a cylinder 3.

In this construction, the compressor has a pair of pistons 4, usually tubular, provided inside the cylinder 3 and axially aligned to each other in order to perform opposite axial movements of mutual separation and approximation, each said piston 4 being individually coupled to a respective actuating means 5, usually tubular and external to the cylinder 3 and provided with a magnet 6, which is axially impelled upon energization of a respective motor portion 2.

The separation and approximation movements of the pistons 4 inside the cylinder 3 determine, respectively, the suction and compression operations of the compressor.

The minimum spacing condition between the motor portions 2 corresponds to the compression end condition. The maximum spacing condition between both motor portions 2 corresponds to the suction end condition.

According to the prior art condition illustrated in FIG. 1, on a top face 4*a* of each piston 4 is mounted a respective suction valve 7, in order to control the passage of gas through the piston 4 to the inside of cylinder 3 during the suction operation of the reciprocating compressor.

In this construction, the gas discharge occurs through a radial slot 8 produced in the lateral wall of the cylinder 3, in a median region thereof defined when the pistons are in a maximum approximation condition (upper dead point), said radial slot 8 being opened to said median region through a discharge orifice 9, radial and median. The gas discharge, which occurs radially, is controlled by a discharge valve 10 positioned in said radial slot 8 and conducted to an opening condition during the mutual approximation of the pistons 4.

This construction has the deficiencies discussed before.

According to the present invention, at least one of the pistons 4 is provided, on its top face 4*a* with a discharge valve 10, for example in the form of a sphere, disc, vane, etc, which controls the axial passage of the gas provided inside cylinder 3 through the respective piston 4 when, during the mutual approximation of said pistons 4 in the compression operation, the pressure in said region of cylinder 3 is higher than the internal pressure of the piston 4 provided with the discharge valve 10. In a preferred construction, the discharge valve 10 is provided centrally on the top face 4*a* of the respective piston 4.

According to the present invention, the discharge valve 10 provided on the top face of a piston 4 is in constant fluid communication with the discharge tube of the compressor through a connecting element 20, flexible, such as a steel tube with a helical shape, which connects the piston 4 to said discharge tube and absorbs the movements of piston 4.

In a construction of the present invention, inside at least one of the pistons 4, is defined at least one discharge chamber 30, in selective fluid communication with the inside of cylinder 3, through a respective discharge valve 10 provided in said piston 4 and in constant fluid communication with the discharge tube of the compressor. In this construction, the connecting element 20, mounted outside the cylinder 3, is opened to an adjacent discharge chamber 30.

Figure 2:
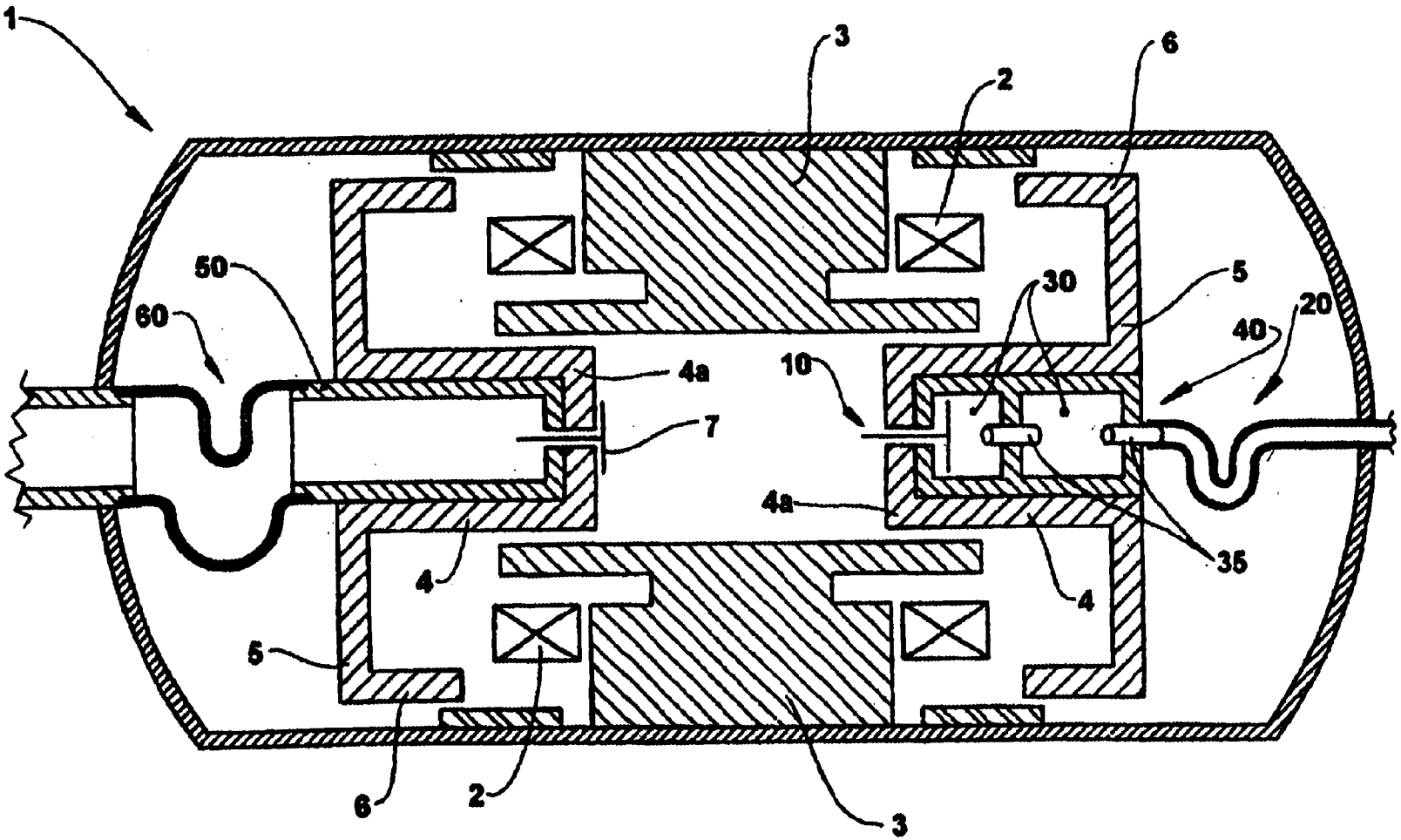
FIG. 2 shows, schematically, a longitudinal diametral sectional view of part of a reciprocating compressor with a linear motor, constructed according to the present invention, with both pistons in the lower dead point position.
Figure 3:
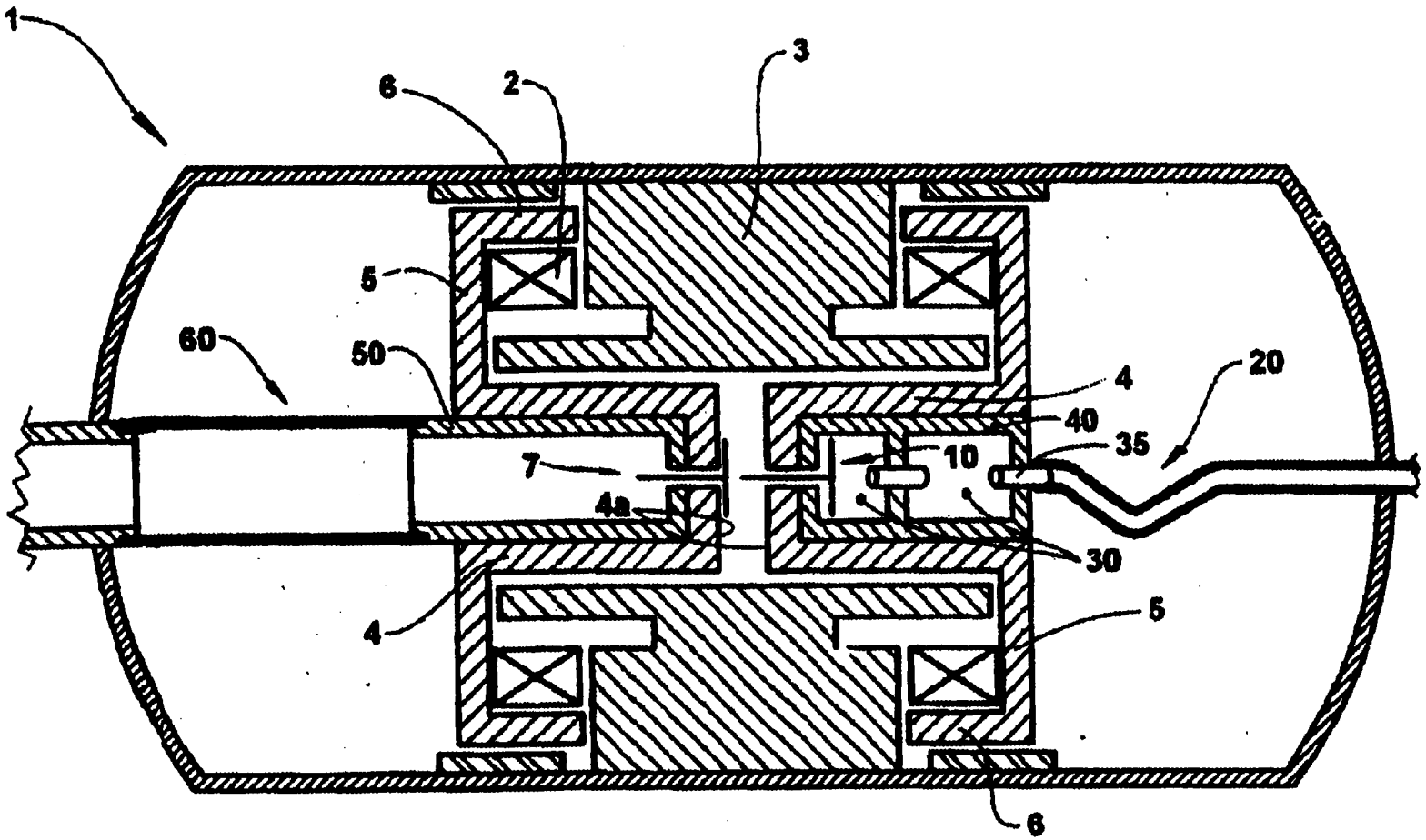
FIG. 3 is a similar view to that of FIG. 1, but illustrating both pistons in the upper dead point position.

According to the illustrations in FIGS. 2 and 3, only one of the pistons 4 is provided with the discharge valve 10, whereas the other of said pistons 4 is provided, on its top face 4*a,* with the suction valve 7. Piston 4 provided with the discharge valve 10 has two discharge chambers 30, axially aligned to each other inside a respective piston 4, the innermost of said chambers being adjacent to the discharge valve 10. The discharge chambers 30 are maintained in constant fluid communication relative to each other and to the discharge side of the compressor through the connecting element 20.

According to the present invention, at least one of the discharge chambers 30 is in the form of an insert 40, for example tubular, lodged inside a piston 4, with its axis being for example aligned with the axis of said piston 4, and preferably occupying the whole internal cross-sectional area of said piston 4.

In the illustrated construction, both discharge chambers 30 are defined in an insert 40, which is tubular and made of a heat insulating material, said discharge chambers 30 being maintained in fluid communication relative to each other through a connecting duct 35 having one of its ends opened to a respective discharge chamber 30.

According to the illustrations, the fluid communication between a discharge chamber 30, the outermost one provided inside the piston 4, also occurs through a connecting duct 35 having an end opened to the inside of the adjacent discharge chamber 30 and the other end connected to the connecting element 20.

Figure 4:
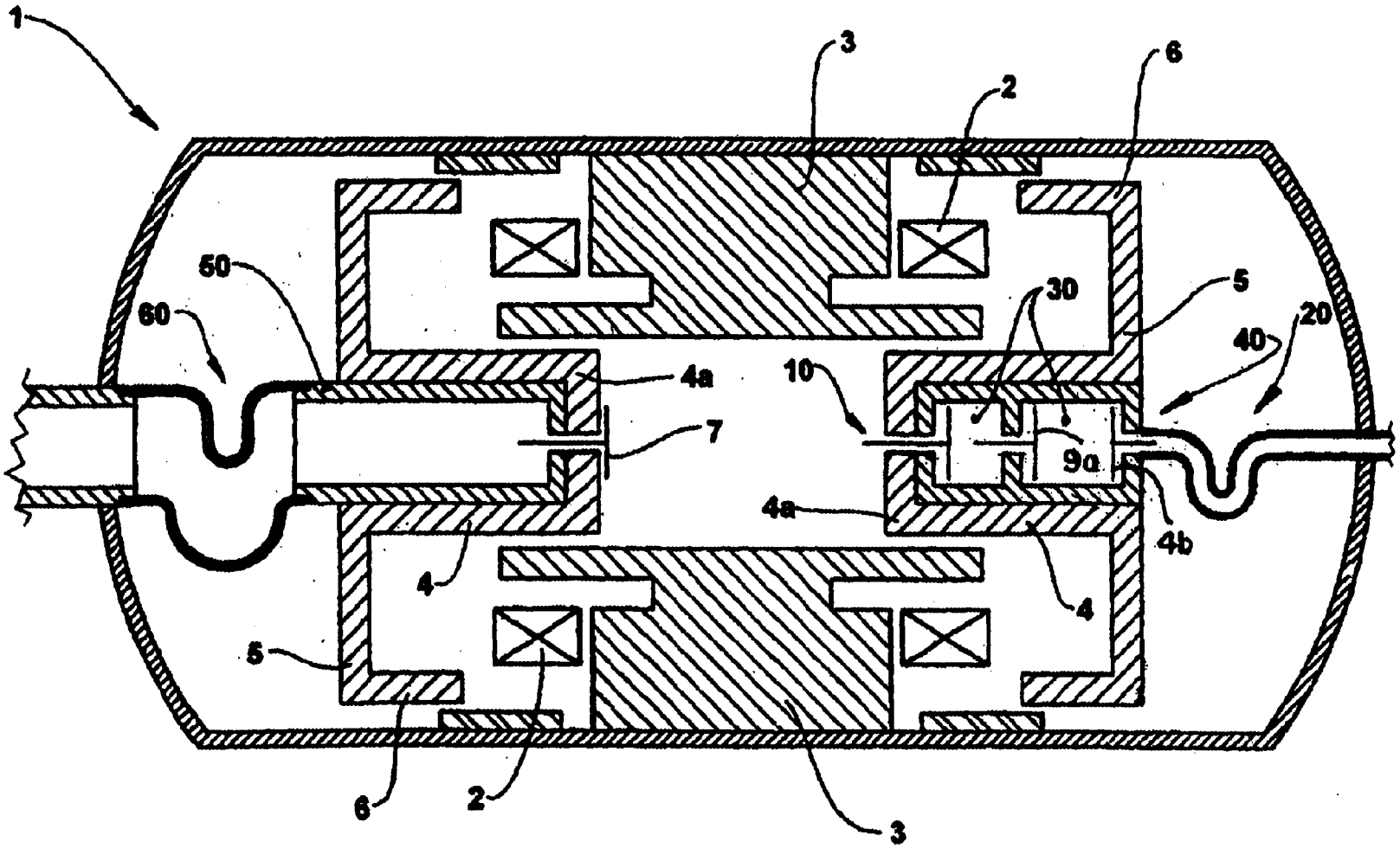
FIG. 4 is a similar view to that at FIG. 2, but illustrating a discharge valve and a suction valve in the piston.

As illustrated in FIG. 4, other constructions are possible for the present invention, such as providing, in the same piston 4, a discharge valve 9*a* and a suction valve 4*b*, coaxially and laterally positioned relative to each other, controlling the passage of gas through the piston 4, through chambers, which are coaxially or laterally provided inside this piston 4 and separated from each other by walls incorporated to the body of piston 4 or also in the form of an insert provided inside said piston 4, in order to define therein the volume of each chamber.

As illustrated in FIGS. 2, 3, and 4, the inside of the piston 4 carrying a suction valve 7 is preferably lined with a tube 50 made of a heat insulating material, with an end projecting outwardly from the piston 4, in order to be connected to a respective flexible tubular element 60, similar to the connecting element 20 and conducted to the suction tube of the refrigeration system to which the compressor is coupled.

What is claimed is:

1. A reciprocating compressor with a linear motor, comprising a cylinder (3); a pair of pistons (4) provided inside the cylinder (3) and axially aligned to each other; a linear motor driving the pistons (4) in, opposite directions; a suction valve (4*b*) provided in at least one of the pistons (4), controlling the gas admission to the inside of the cylinder (3); and a discharge valve (9) provided in order to control the discharge of the gas admitted inside the cylinder (3) said pistons (4) being provided, on its top face (4*a*), with a respective discharge valve (10), in order to control the axial discharge of the gas through said piston (4), characterized in that it comprises at least one discharge chamber (30) defined of a heat insulating material inside at least one of the pistons (4) and in selective fluid communication with the inside of the cylinder (3) through a respective discharge valve (10).

2. Compressor, as in claim 1, characterized in that it comprises two discharge chambers (30) maintained in fluid communication relative to each other inside a respective piston (4), one of said discharge chambers (30) lodging the discharge valve (10).

3. Compressor, as in claim 2, characterized in that the discharge valve (10) is centrally mounted on the top face (4*a*) of the respective piston (4).

4. Compressor, as in claim 3, characterized in that each discharge chamber (30) occupies the whole internal cross-sectional area of piston (4).

5. Compressor, as in claim 4, characterized in that at least one of the discharge chambers (30) is in the form of an insert provided inside the respective piston (4).

6. Compressor, as in claim 5, characterized in that each insert is made of a heat insulating material.

7. Compressor, as in claim 6, characterized in that the insert is tubular.

8. Compressor, as in claim 1, characterized in that the discharge valve (10) is maintained in constant fluid communication with a discharge tube of the compressor through a connecting element (20), flexible connecting the piston (4) to said tube.

* * * * *